United States Patent [19]

Petri et al.

[11] Patent Number: 4,572,225

[45] Date of Patent: Feb. 25, 1986

[54] APPARATUS FOR COUNTING COINS OR SIMILAR DISCS

[75] Inventors: Bernd Petri, Oftersheim; Jürgen Riffel, Bruchsal, both of Fed. Rep. of Germany

[73] Assignee: Standardwerk Eugen Reis GmbH, Bruchsal, Fed. Rep. of Germany

[21] Appl. No.: 108,042

[22] Filed: Dec. 28, 1979

[30] Foreign Application Priority Data

Nov. 10, 1978 [DE] Fed. Rep. of Germany ..... 2848760

[51] Int. Cl.[4] ..... G07D 9/04

[52] U.S. Cl. ..... 133/8 E; 133/8 R

[58] Field of Search ..... 133/8 E, 8 A, 8 R, 3 F, 133/3 E, 3 D

[56] References Cited

U.S. PATENT DOCUMENTS

| | | | |
|---|---|---|---|
| 1,546,014 | 7/1925 | Downey | 133/8 A |
| 3,754,558 | 8/1973 | Conant et al. | 133/3 R |
| 4,088,144 | 5/1978 | Zimmermann | 133/8 E X |

*Primary Examiner*—F. J. Bartuska

*Attorney, Agent, or Firm*—Murray Schaffer

[57] ABSTRACT

Coins are supplied in an endless file on track having marginal edges preventing lateral movement to a counting station at which a sensor is provided. Provided also at the counting station is a stop member actuated by an electro-magnetic responsive to the counting of a predetermined number of coins to interpose the stop member in the marginal spaces between the coins after first engaging the last coin of the count at the counting station.

7 Claims, 5 Drawing Figures

APPARATUS FOR COUNTING COINS OR SIMILAR DISCS

The invention relates to apparatus for the counting of coins or other disk-shaped objects, wherein the coins are placed in single file for the counting process through the operation a centrifugal disk, above which a gap is formed for the inflow of the individual coins or objects onto a counting track on which the onward movement takes place through an endless V-belt running over the coins or objects and on which the counting occurs through a sensor.

Such a counting apparatus, which has proved successful in the practice in many instances, has become known through DE-OS No. 20 59 007. It makes possible a throughput which is a multiple of that of the counting machines known until then. A contributing factor is above all the positive conduction of the coins, which is maintained by the V-belt drive up to the end of the mounting track.

In addition to these advantages it has been found also, however, that precisely the high throughput complicates an exact counting of predetermined quantities of any size. The stopping of the coin flow on the counting track, precisely so that the last coin still belonging to the quantity being counted is conveyed away and the next following coin is stopped by the disconnection of the V-belt drive or by similar measures, could not until now be controlled with absolute certainty. This problem, decisive for the accuracy of any counting process, has heretofore remained unsolved in practice, especially when coins of smallest diameter were being processed.

From this resulted the task underlying the invention, which consisted in creating for counting equipments an exact and absolutely reliable disconnection of the coin flow on the counting track, which is of simple construction and with which the disadvantages of the known equipments are eliminated.

This problem is solved according to the invention, for an apparatus of the above described kind, in that directly next to the counter-sensor, which in known manner is located vertically below the counting track, there is arranged on a lock bolt a lock pin which is movable parallel to the counter-sensor and which is driven by a reversing electro-magnet. The lock pin penetrates through the counting track and there, first coming to bear under one of the moving coins, then advances into the interspace between it and the next following coin so as to block the movement of the subsequent coins on the counting track.

To create a minimum distance between the counter-sensor and the lock pin, so that the latter can penetrate also into the interspace which coins of smallest diameter have, the lock pin is arranged eccentrically to the axis of the lock bolt on a carrying collar thereof.

For absorption of the lateral forces which can act from the row of moving coins onto the eccentrically placed lock pin, the lock bolt is additionally mounted for vertical movement within a supporting claw bracket mounted a guide pin.

To be able to keep the structural height of the entire apparatus as low as possible, the reversing magnet, which is energized from the counter-sensor through a control and checking device and whose armature bar moves the lock pin, is arranged on the chassis and the actuation of the lock pin occurs through an articulating linkage comprising a ram at the reversing magnet, a rocker and through another ram at the lock bolt.

The special advantages of the apparatus according to the invention reside above all in that with it any desired, previously fixed number of coins can be counted exact to the last piece, with observance of an absolutely reliable result, even when coins of smallest diameter are involved. Any moving up of the coin flow on the counting track, which may otherwise always occur after disconnection of the belt drive transporting the coins, is prevented positively by the lock pin moving into the counting track. Furthermore, the apparatus is of simple construction and therefore can be used to advantage also for the subsequent retro-fitting of counting machines already in operation.

In the following, the invention will be explained further with reference to the drawing, which illustrates as an embodiment an apparatus for the counting of coins.

In the figures

Figure 1:
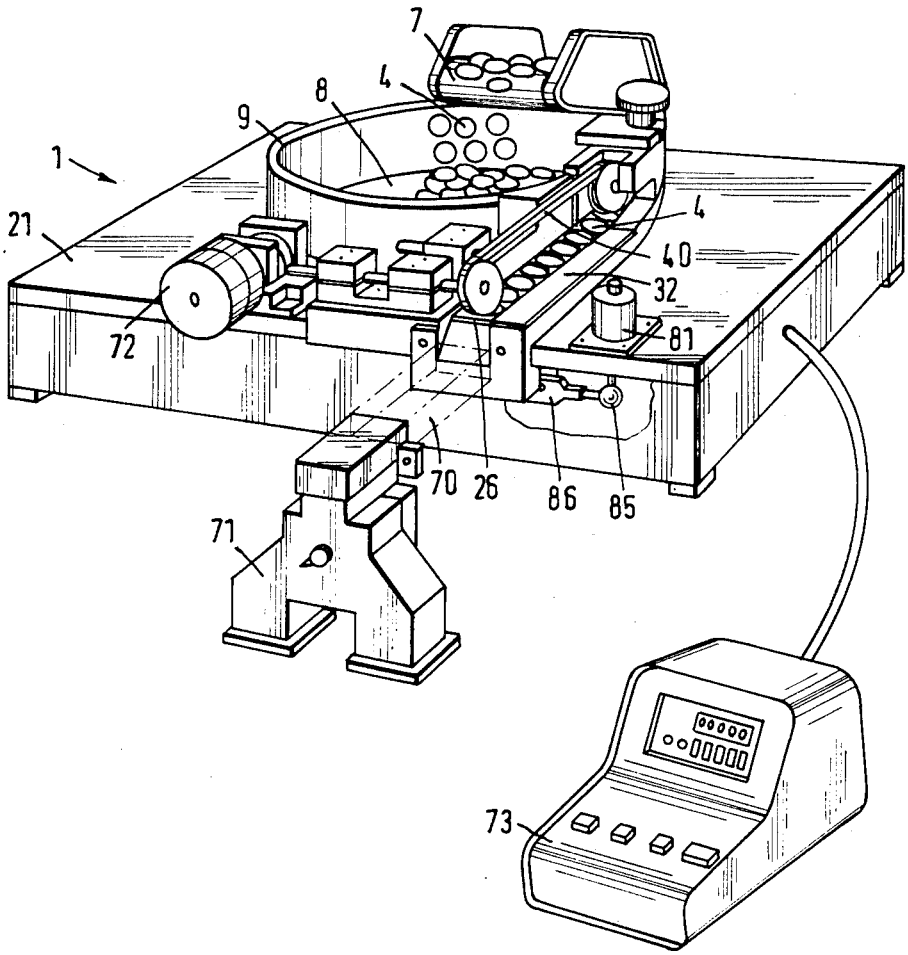
FIG. 1 is a perspective view of a coin counting machine with control and checking device.
Figure 2:
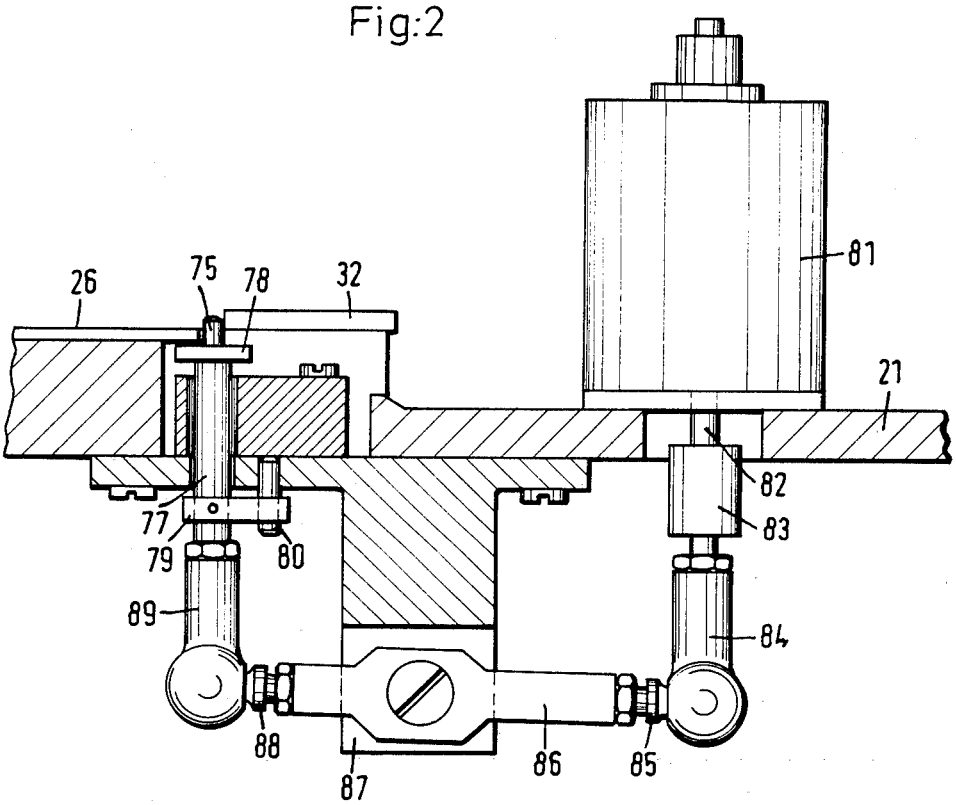
FIG. 2 is an enlarged view of the locking means in longitudinal section.

As seen in FIG. 1, the coin counting machine generally depicted by the number 1, is provided with a chassis 21 to which coins 4 are supplied over a conveyor belt 7 from a magazine not shown. These coins 4 go onto a centrifugal disk 8, which is bounded by a ring 9 angular in cross-section which in known manner forms an annular gap above the disk through which the coins 4 are driven singly and successively to a counting station 26, whence they pass through a chute 70 into a drop funnel, here shown as a double drop funnel 71, and thence to packing machines or into collecting bins.

So that there will be no speed lost at the counting section 26, this station is spanned by the endless V-belt 40, which is endlessly driven and whose lower run transports the coins 4 to the drop chute 70 at the speed of the centrifugal disk.

Figure 4:
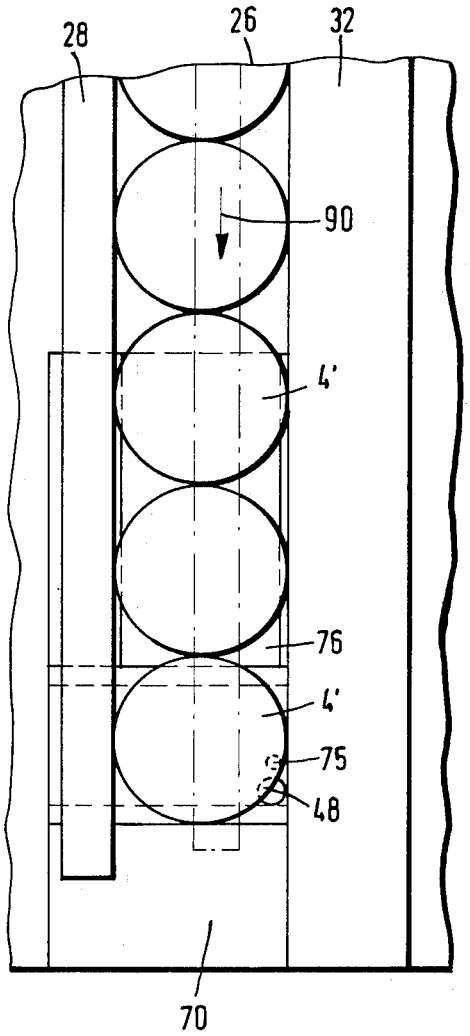
FIG. 4 is a plan view of the counting station, during passage of large coins.
Figure 5:
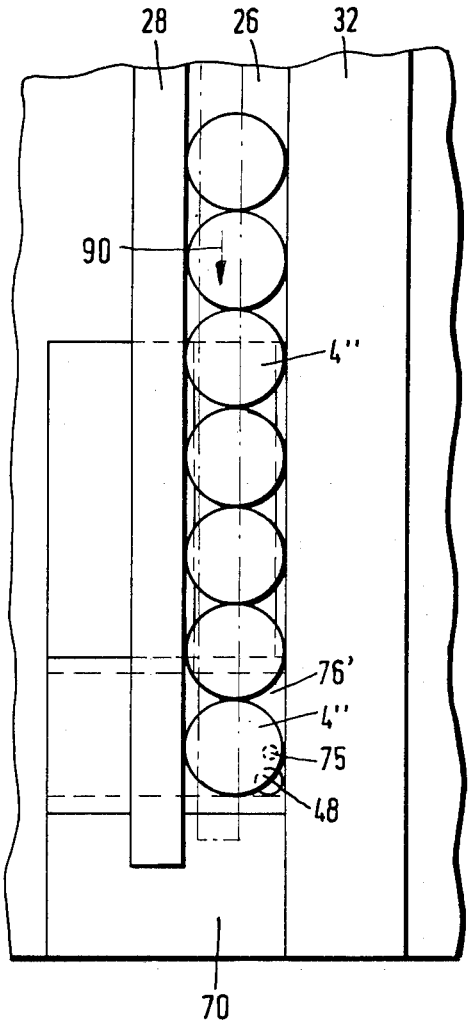
FIG. 5 is a view similar to FIG. 4, during passage of small coins.

As seen in FIGS. 4 and 5, station 26 is formed by an adjustable guide track 28 having a lateral retaining edge and a fixed guide rail 32 so that its breadth may be varied depending on the diameter of the coins 4 being processed. The breadth of the counting station 26 is adjustable and settable through the setting button 72 regulating the position of the guide track 28 relative to the fixed rail 32.

Figure 3:
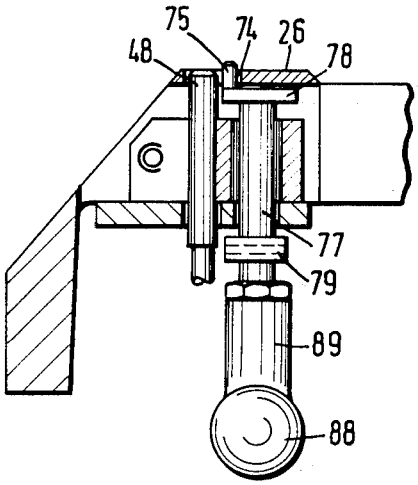
FIG. 3 is a view of the locking means according to FIG. 2 in transverse section.

As seen in FIGS. 3–5, in the counting station 26, there is disposed a sensor 48, which in known manner controls the counting process inductively, without the need to move mechanical parts. To this end the sensor 48 is located at the edge of the fixed guide rail 32, so that the counting pulses can clearly be obtained through the 76 between the coins 4 sliding over the track which space necessarily results due to the roundness of the coins, and can thus be amplified to a reliable counting signal. Each counting signal is passed on to a control and checking device 73 and processed there for comparison with the count nominal value, for electronic direct indication, and for any desired other functions.

As seen in FIG. 3, the sensor 48, located at the end of the counting station 26 next to the fixed guide rail 32, stands perpendicular to the track 28. Directly next to it, at the smallest possible distance, the counting station 26 has a bore 74, through which a lock pin 75 can protrude above the track 28 and block the course of the coins 4. To this end the locking pin 75 enters into the interspace 76 present between two coins. The thickness of the lock pin 75 is therefore somewhat less than the interspace 76 which the coins of smallest diameter form.

In order to achieve with the position of the lock pin 75 the greatest possible approximation to the sensor 48 the lock pin 75 is arranged eccentric to the axis of the bolt 77 moving it. The lock pin is mounted at the edge of a carrying collar 78 which is mounted on the bolt 77.

The lateral forces acting on the locking pin from the locking force are absorbed by a retaining claw 79 secured to the bolt 77 and held by a guide pin 80.

The actuation of the lock pin 75 occurs from the polarized reversing of an electro magnet 81, which receives its pulses from the control and checking device 73. To this end there is connected to the armature bar 82 of the magnet 81, via the adjusting threaded piece 83, a ram 84 and angle joint 85-A rocker 86, is pivotably mounted in a block 87 and is in connection via the further angle joint 88 as well as the ram 89 with the lock bolt 77 and hence via the carrying collar 78 also with the lock pin 75.

Naturally the armature bar 82 of the reversing magnet 81 may also sit directly under the lock bolt 77 and be connected with it without intermediate levers. This would merely increase the structural height of chassis 21 of the coin counting machine 1.

With reference to FIGS. 4 and 5 the operation of the apparatus is explained once more below.

Between the guide track 28 and the fixed guide rail 32 there is formed the counting station 26, over which the coins 4' and 4'' are conveyed by the V-belt 40 (FIG. 1) in the direction of arrow 90, to the drop chute 70. At the end of the counting station 26, on the side of the fixed guide rail 32, there are the sensor 48 and directly next to it the lock pin 75. Each transported coin 4', 4'' thus runs over both the sensor 48 and the lock pin 75, which during the counting process is pulled back by the reversing magnet 81 to a position beneath the counting station 26. For each transported coin 4', 4'' the sensor 48 gives a counting pulse to the control and checking device 73 whose preselection counter is set to the number of coins 4', 4'' to be counted. As soon as the last coin belonging to this group covers the sensor 48 in passing through the counting station 26, the counter gives the control and checking device a pulse for the operation of the reversing magnet 81, which thereupon actuates the rocker 86 and moves the the lock pin 75 upwardly. The lock pin 75 now first places itself under the last coin 4', 4'' belonging to the count, which coin is still to be delivered into the drop chute 70. Thereafter the lock pin enters into the interspace 76 and thus positively blocks off the continued run of the next and the following coins 4', 4''.

At the same time also the drive of the V-belt 40 is turned off and the advance of the coins stopped.

The next counting process begins with a reversing pulse to the magnet 81, which pulls the lock pin 75 down again below the counting section 26, and with the switching on of the drive of the V-belt 40, which sets the coin flow in motion again, until the applicable count quantity is reached again.

The operation of the apparatus is absolutely reliable because the lock pin 75 always inserts itself positively into the interspece between the last coin still belonging to the count quantity and the following coin to be stopped. The arrangement of the lock pin 75, directly at the sensor 48 so that the lock pin always strikes the underside of the last coin still to be counted results in positively insuring that the pin must necessarily enter into the next coin interspace. This applies both to coins 4' of large diameter and to coins 4'' of smallest diameter. The lock pin 75 will always insert itself in the respective interspace 76 or respectively 76' because at the end of a counting process it has already been caused to make contact under the last coin.

Naturally, also any other disk-shaped metallic objects besides coins can be counted with the apparatus according to the invention.

For the counting of non-metallic objects a light sensor is used in known manner instead of an inductive sensor described. No change occurs in the arrangement of the lock pin 75 and of the entire locking system.

Also it is within the scope of the invention to arrange the locking system with the sensor or respectively a light sensor and the lock pin, instead of below the counting station—as described in the embodiment—above the same and to let is act in the same manner downwardly, into the coin stream.

We claim:

1. Apparatus for counting coins or the like of the same diameter, comprising a flat track with marginal edges on which said coins may be arranged in single file without lateral movement, means for feeding a substantially endless stream of coins to one end of said track, means for propelling said coins along said track in successive abutting relationship and providing a space between successive coins along the marginal edges of the track, a counting station located downstream of the feeding means along one marginal edge of said track and in alignment with the spaces between successive coins, said counting station being provided with means for sensing individual coins passing said counting station and stop means in close proximity to said sensing means, both the sensing means and the stop means being in alignment with the lateral spaces between successive coins, and in such close proximity as to be able to be simultaneously traversed by a single one of said coins, actuating means operative to move said stop means in response to a signal and control means responsive to the sensing of the last of a predetermined number of individual coins for producing a signal causing said actuating means to move said stop means initially into engagement with a face of said last of the predetermined number of coins simultaneously with its passing the counting station and thereafter on passage of said last of the predetermined coins to penetrate into the interspace between the last of the predetermined coins and the next successive coin on said track to block the movement of coins therealong.

2. The apparatus according to claim 1 wherein said stop means and sensing means are arranged parallel to and in close proximity to each other.

3. The apparatus according to claim 2 wherein said track is provided with an opening at said counting station and said sensing means comprises a sensor extending operatively through said opening and said stop means comprises a pin movable into and out of said opening.

4. The apparatus according to claim 3 wherein said stop means is mounted below said track and is movable in a direction perpendicular thereto through said opening, and said means for propelling said coins comprises an endless belt engaging the upper surface of said coins.

5. The apparatus according to claim 3 wherein said actuating means comprises an electro-magnetic having a reciprocable ram, said pin being mounted on a reciprocating bolt linked to said ram.

6. The apparatus according to claim 4 wherein said bolt is slidably retained in bracket sufficient to absorb lateral forces, and said pin is mounted eccentrically to said bolt on a collar secured to the end of said bolt.

7. The apparatus according to claim 5 including a housing, said electro-magnet being mounted on said housing and linked to said bolt by a rocker arm pivotably attached at one end to said ram and at its other end to said bolt.

* * * * *